United States Patent [19]

Wright

[11] Patent Number: 5,061,207

[45] Date of Patent: Oct. 29, 1991

[54] CONNECTOR FOR A SHIELDED COAXIAL CABLE

[75] Inventor: John O. Wright, York, Pa.

[73] Assignee: GTE Products Corporation, Stamford, Conn.

[21] Appl. No.: 588,864

[22] Filed: Sep. 27, 1990

[51] Int. Cl.[5] ..... H01R 13/00

[52] U.S. Cl. ..... 439/578

[58] Field of Search ..... 439/578–585, 439/741

[56] References Cited

U.S. PATENT DOCUMENTS 3,047,828 7/1962 Gregson et al. ..... 439/582

4,360,244 11/1982 Forney, Jr. et al. ..... 439/582

*Primary Examiner*—Joseph H. McGlynn

*Attorney, Agent, or Firm*—William H. McNeill

[57] ABSTRACT

A connector for use in effecting a solderless electrical and mechanical connection to a shielded coaxial cable including retaining tabs which extend from a ferrule and engage a bushing to mechanically connect the ferrule to a connector housing and electrical contact tabs which extend from the retaining tabs to electrically and mechanically connect the ferrule to an inner lead such as a signal lead of the cable.

30 Claims, 2 Drawing Sheets

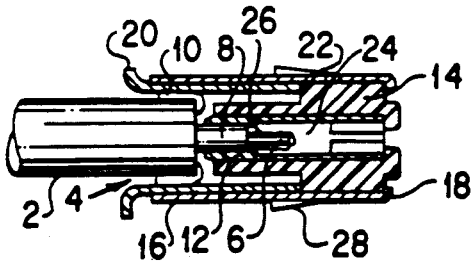
FIG. 1 PRIOR ART
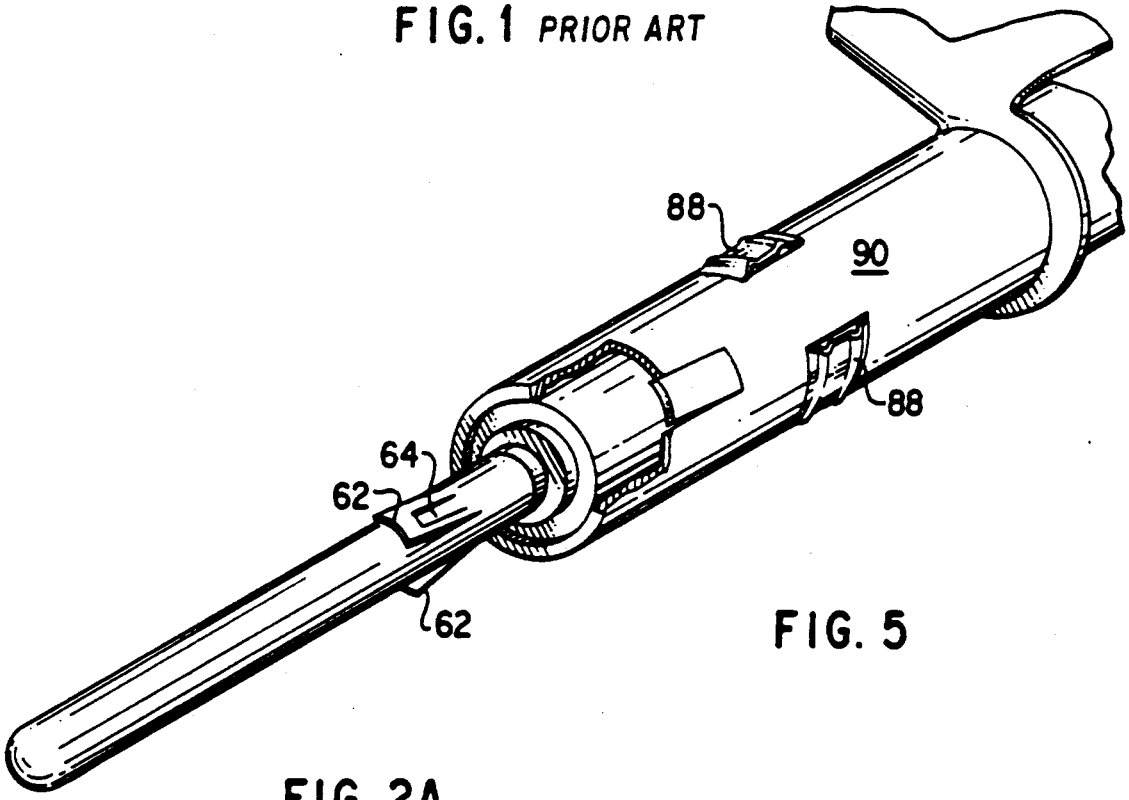
FIG. 5
FIG. 2A
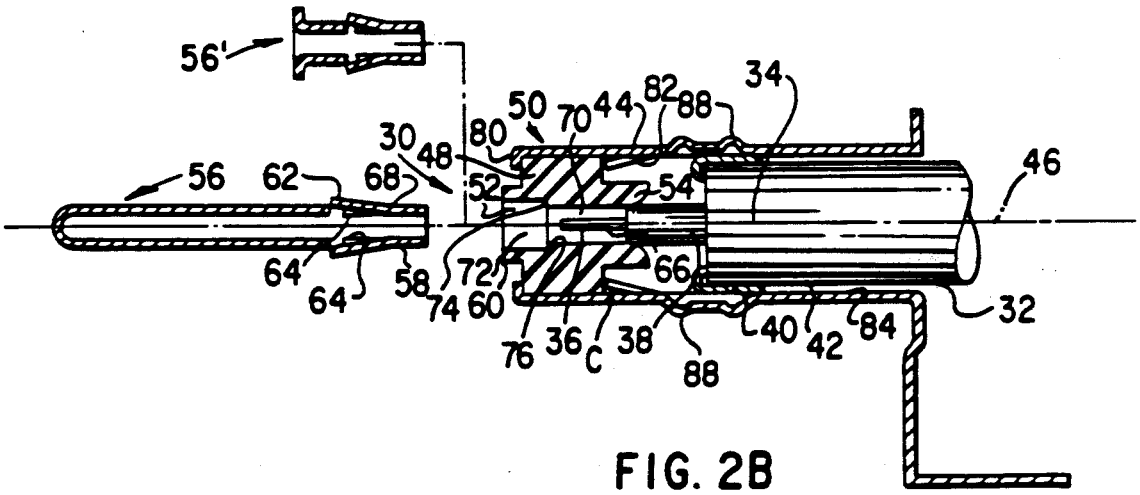
FIG. 2B

CONNECTOR FOR A SHIELDED COAXIAL CABLE

CROSS-REFERENCE TO RELATED APPLICATIONS

Applications Ser. No. 07/588,780 and 07/588,781, filed concurrently herewith, contain related subject matter. All are assigned to the same assignee.

BACKGROUND OF THE INVENTION

1. Field of the Invention

The present invention relates to a connector for attachment to the end of a shielded coaxial cable for use, for example, in effecting an audio antenna connection.

2. Description of the Prior Art

Heretofore, the typical audio antenna connector has been attached to a coaxial cable by hand. In fabricating such a connector, the inner lead of the cable, which serves as the signal wire, has been soldered to a female lug or male pin of the connector. For example, FIG. 1 depicts one known typical female audio antenna connector. Such connector includes a coaxial cable 2 having an end 4 which has been stripped in a known manner such that the signal wire 6 and the signal wire insulator 8 extend from the end 4. The usual shield layer 10 is folded back upon the cable 2. The signal wire insulator 8 is disposed within a plastic sleeve 12 which is disposed within a plastic bushing 14. Bushing 14 is held in place within an outer metal shell 16 by means of a flanged portion 18 of the outer metal shell and an inner metal shell 20 force fit between the shield layer 10 and outer shell 16 and in abutment with the plastic bushing 14 at 22. The electrical connection is completed by soldering the signal wire 6 to a lug 24 at 26. During use, the connector is held in place by means of retention fingers 28. It will be apparent to those skilled in the art that fabrication of such a connector involves several parts and several distinct steps including the application of solder to effect an electrical connection. The use of such a solder connection typically requires hand assembly which adds to the cost of fabrication. The retention fingers 28 also provide less than desirable retention in the socket of, for example, a radio.

It is desired to provide a connector for electrical connection to a coaxial cable for use, for example, in effecting an audio antenna connection, which includes a reduced number of parts and fabrication steps. It is further desirable to provide such a connector which does not require the use of solder in effecting an electrical connection between cable and connector. It is also desirable to provide such a connector which is automatable, the need for hand assembly being eliminated. It is further desired to provide such a connector having improved retention in a socket. It is also desirable to provide such a connector which can be manufactured at reduced costs.

SUMMARY OF THE INVENTION

This invention achieves these and other results by providing a shielded coaxial cable having a connector mechanically and electrically attached thereto, comprising an elongated metal tubular connector housing extending along a longitudinal axis and having a plastic bushing internal of and attached at one end thereof. The busing includes a longitudinal bore extending therethrough along the longitudinal axis. A shielded coaxial cable is provided having an end portion extending into an opposite end of the housing. An exposed length of an inner lead and an exposed length of an inner lead insulator extend from the end portion along the longitudinal axis of the housing and into a first end of the longitudinal bore. The end portion includes a shield layer folded back upon an outer surface of the shielded coaxial cable between the outer surface and an inner surface of the housing. A tubular ferrule is provided having one end which extends into an opposite second end of the longitudinal bore and includes at least one retaining tab which is biased away from the longitudinal axis against an inner bore wall of the longitudinal bore. Each retaining tab includes an electrical contact tab which is biased toward the longitudinal axis against an outer surface of the inner lead. The present invention provides for a connector per se as well as a combination shielded coaxial cable having such a connector electrically and mechanically attached thereto.

BRIEF DESCRIPTION OF THE DRAWINGS

This invention may be clearly understood by reference to the attached drawings in which:

FIG. 1 is a view of a prior art shielded coaxial cable having a connector soldered thereto;

FIG. 2 is a view of the connector/cable combination of the present invention partially assembled to effect a male connection;

FIG. 2A is a view of a female ferrule for use when it is desired that the connector/cable combination of FIG. 2 effect a female connection;

FIG. 5 is an elevational view of the connector/cable combination of the present invention during assembly.

DESCRIPTION OF THE PREFERRED EMBODIMENT

Figure 4:
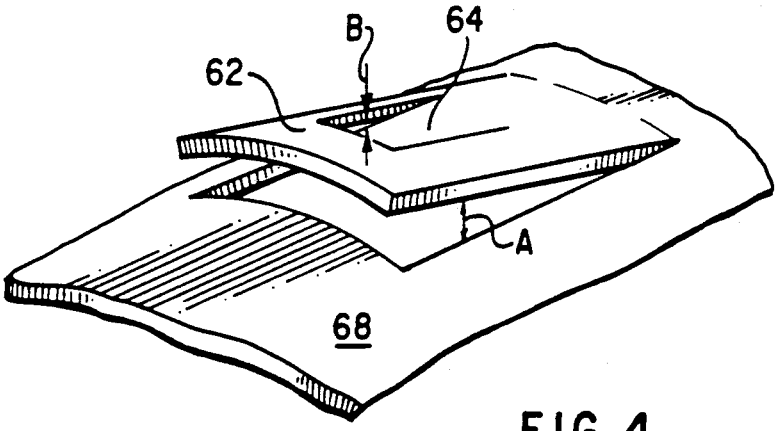
FIG. 4 is a view of a retaining tab and electrical contact tab of the present invention.

The embodiment which is illustrated in the drawings is one which is particularly suited for achieving the objects of this invention. FIGS. 2 to 5 depict a connector 30 for electrical and mechanical connection to a shielded coaxial cable 32 which has an end portion 34 including an exposed length of an inner lead 36 and an exposed length of an inner lead insulator 38 extending from end portion 34. When used to effect an audio antenna connection, the inner lead 36 provides a signal wire in a known manner. A typical shield layer 40 is folded back upon an outer surface 42 of the cable 32. Shielded coaxial cable 32 can be any known shielded coaxial cable useful, for example, in connecting an antenna to a radio or any other antenna application.

The connector 30 includes an elongated metal tubular connector housing 44 which extends along a longitudinal axis 46. A bushing 48 fabricated from plastic such as, for example, PBT a thermoset material, such as Phenolic, is provided internal of and attached at one end 50 of housing 44. Bushing 48 includes a longitudinal bore 52 extending therethrough along axis 46. Longitudinal bore 52 has a first end 54 for inserting the exposed length of inner lead 36 and the exposed length of inner lead insulator 38 when connecting the shielded coaxial cable 32 to the connector 30.

Connector 30 also includes a metal tubular ferrule 56. In the embodiment of FIGS. 2 to 5, ferrule 56 is a male ferrule. FIG. 2A depicts a female ferrule 56' which is structurally and functionally identical to ferrule 56 with the exception that ferrule 56 provides a male connection and ferrule 56' provides a female connection. Ferrule 56 includes one end 58 for insertion into an opposite second end 60 of the longitudinal bore 52 when connecting the shielded coaxial cable 32 to connector 30. Ferrule 56 includes at least one retaining tab 62 which is biased away from longitudinal axis 46 and against an inner bore wall of longitudinal bore 52 during insertion of the ferrule into the bore. Retaining tab 62 provides a mechanical connection between the ferrule 56 and bushing 48. Retaining tab 62 includes an electrical contact tab 64 which is biased toward longitudinal axis 46 against an outer surface 66 of inner lead 36 during insertion of the ferrule into the bore. Electrical contact tab 64 provides a mechanical and electrical connection between the ferrule 56 and inner lead 36. In the preferred embodiment there is a plurality of retaining tabs 62, the embodiment depicted in the drawings including two retaining tabs 62 circumferentially spaced 180°. It will be apparent to those skilled in the art that any other number of such retaining tabs can be used.

In the preferred embodiment, each retaining tab 62 is integral with the metal tubular ferrule 56 and each electrical contact tab 64 is integral with a retaining tab 62 as depicted in FIG. 4. In the preferred embodiment, ferrule 56 is fabricated from phosphor bronze or other alloys which provide a natural bias or resiliency in tabs 62 and 64 when such tabs are stamped or otherwise angularly oriented relative to the outer surface 68 of the ferrule. In the preferred embodiment each retaining tab 62 protrudes at an angle A away from an axis of the tubular ferrule 56 and away from end 58 of ferrule 56. The ferrule axis is coincident with longitudinal axis 46 when the ferrule has been inserted into the connector 30. Similarly, each electrical contact tab 64 is integral with a respective retaining tab 62 and protrudes at an angle B towards such ferrule axis and away from end 58 of ferrule 56. In the preferred embodiment, angle A is about 15° and angle B is about 15°.

In the preferred embodiment, the longitudinal bore 52 includes a first bore length 70 adjacent end 54 and a second bore length 72 adjacent end 60. The diameter of the second bore length 72 is greater than the diameter of the first bore length 70 to form an annular abutment 74. In such embodiment, each retaining tab 62 is biased away from longitudinal axis 46 against an inner bore wall 76 of the first bore length 70 as depicted in FIG. 3.

Figure 3:
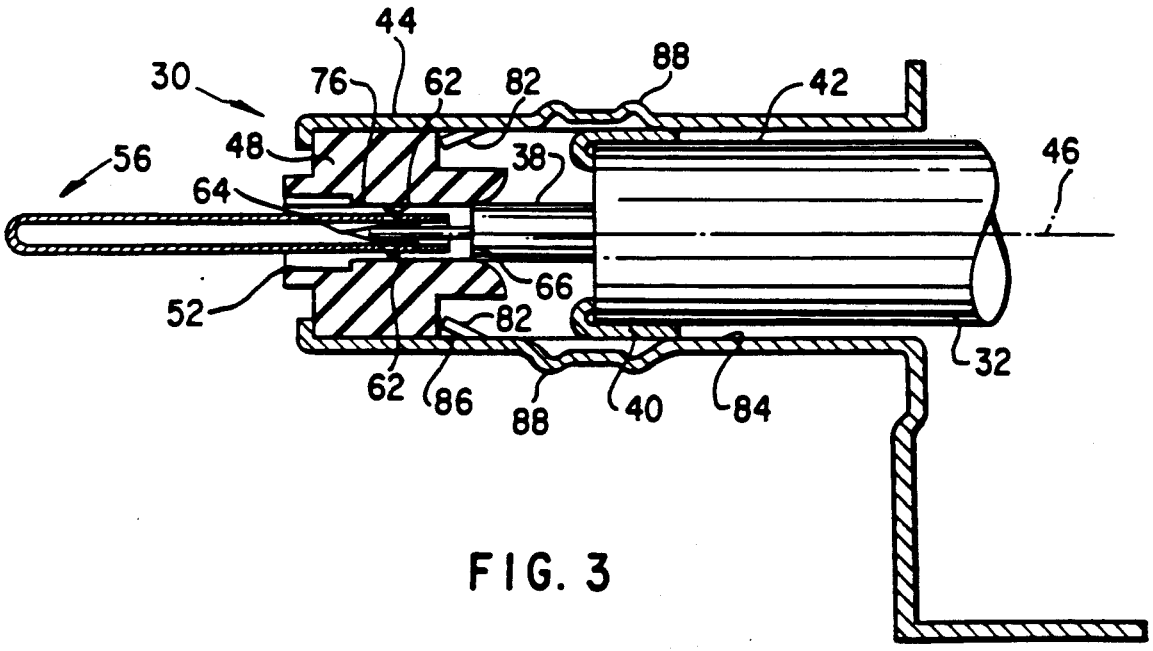
FIG. 3 is a view of the connector/cable combination of FIG. 2 fully assembled.

In the preferred embodiment the elongated tubular connector housing 44 includes a flanged end portion 80 at end 50 and at least one flexible protuberance 82 spaced from the flanged end portion 80 and extended into the housing 44 as depicted in FIGS. 2 and 3. Plastic bushing 48 is held in place between the flanged end portion 80 and the flexible protuberance 82. In the preferred embodiment there is a plurality of flexible protuberances 82, the embodiment depicted in the drawings including two protuberances 82 circumferentially spaced 180°. It will be apparent to those skilled in the art than any other number of such protuberances can be used.

In the preferred embodiment each protuberance 82 is integral with the metal housing 44. Preferably, housing 44 is fabricated from brass or a copper alloy which provides a natural resiliency in protuberances 82 when such protuberances are stamped or otherwise angularly oriented relative to the inner surface 84 of the housing 44. In the embodiment of FIGS. 2 and 3, each protuberance 82 protrudes at an angle C away from inner surface 84. Preferably angle C is 20°.

In the preferred embodiment, the metal housing 44 also includes at least one ribbed portion 88 expanded away from an outer surface 90 of the housing to provide a retention means which effects improved retention when the connector 30 is inserted into, for example, a typical antenna socket of a radio. It will be apparent to those skilled in the art that any number of such ribbed portions can be provided. In the embodiment depicted in the drawings there are four ribbed portions circumferentially equally spaced, only two being depicted in FIGS. 2, 3 and 5.

In assembling the device described herein, an end 34 of coaxial cable 32 is stripped in a known manner to provide an exposed length of inner lead 36 and an exposed length of inner lead insulator 38. Then the shield layer 40 is folded back upon the outer surface 42 of cable 32. Such cable end is inserted into the elongated metal tubular connector housing 44 until the inner lead insulator 38 enters length 70 of the longitudinal bore 52 as depicted in FIG. 3. During such insertion, the shield layer 40 will be sandwiched between the outer cable surface 42 and the inner surface 84 of the housing 44 effecting electrical contact between the shield layer and the housing. Then a male or female ferrule (55, 56') is inserted into the length 72 of the longitudinal bore 52. Insertion continues as end 58 of the ferrule enters length 70 of the longitudinal bore 52. In this manner, the bore surface 76 of length 70 acts as a cam surface relative to retaining tabs 62 depressing tabs 62 toward axis 46 to effect a force fit between tab 62 and surface 76. Such force fit provides very satisfactory retention of the ferrule 56 relative to the bushing 48 which is retained within housing 44 by means of flanged end portion 80 and protuberances 82. As retaining tabs 62 are cammed inward toward axis 46 by surface 76, the electrical contact tabs 64 which are integral with the retaining tabs 62 are urged toward axis 46 and into engagement with the inner lead 66 to effect a solderless electrical and mechanical contact therewith. It will be apparent to those skilled in the art that solder can be used between tab 64 and inner lead 36 if desired, although a satisfactory electrical and mechanical connection can be effected without solder.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A shielded coaxial cable having a connector mechanically and electrically attached thereto comprising:

an elongated metal tubular connector housing extending along a longitudinal axis;

a plastic bushing internal of and attached at one end of said housing, said bushing having a longitudinal bore extending therethrough along said longitudinal axis;

a shielded coaxial cable having an end portion extending into an opposite end of said housing, an exposed length of an inner lead and an exposed length of an inner lead insulator extending from said end portion along said longitudinal axis and into a first end of said longitudinal bore, said end portion having a shield layer folded back upon an outer surface of said shielded coaxial cable between said outer surface and an inner surface of said housing; and, a tubular ferrule having one end which extends into an opposite second end of said longitudinal bore and includes at least one retaining tab which is biased away from said longitudinal axis against an inner bore wall of said longitudinal bore, said at least one retaining tab including an electrical contact tab which is biased toward said longitudinal axis against an outer surface of said inner lead.

2. The shielded coaxial cable of claim 1 wherein said elongated metal tubular connector housing further includes at least one ribbed portion expanded away from an outer surface of said housing.

3. The shielded coaxial cable of claim 1 wherein said at least one retaining tab includes a plurality of retaining tabs.

4. The shielded coaxial cable of claim 3 wherein each retaining tab of said plurality of retaining tabs is integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

5. The shielded coaxial cable of claim 1 wherein said longitudinal bore includes a first bore length adjacent said first end of said longitudinal bore and a second bore length adjacent said opposite second end of said longitudinal bore, said second bore length having a diameter which is greater than the diameter of said first bore length and extending to said first bore length to form an annular abutment.

6. The shielded coaxial cable of claim 5 wherein said at least one retaining tab includes a plurality of retaining tabs each of which is biased away from said longitudinal axis against an inner bore wall of said first bore length.

7. The shielded coaxial cable of claim 6 wherein each retaining tab of said plurality of retaining tabs in integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

8. The shielded coaxial cable of claim 7 wherein said tubular ferrule further includes a ribbed portion which engages said annular abutment.

9. The shielded coaxial cable of claim 1 wherein said housing includes a flanged end portion at said one end and at least one flexible protuberance spaced from said flanged end portion and extending into said housing from an inner surface of said housing, said plastic bushing being held in place between said flanged end portion and said at least one flexible protuberance.

10. The shielded coaxial cable of claim 9 wherein said longitudinal bore includes a first bore length adjacent said first end of said longitudinal bore and a second bore length adjacent said opposite second end of said longitudinal bore, said second bore length having a diameter which is greater than the diameter of said first bore length and extending to said first bore length to form an annular abutment.

11. The shielded coaxial cable of claim 10 wherein said at least one retaining tab includes a plurality of retaining tabs each of which is biased away from said longitudinal axis against an inner bore wall of said first bore length.

12. The shielded coaxial cable of claim 11 wherein each retaining tab of said plurality of retaining tabs is integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

13. The shielded coaxial cable of claim 12 wherein said tubular ferrule further includes a ribbed portion which engages said annular abutment.

14. The shielded coaxial cable of claim 13 wherein said tubular ferrule is a male ferrule.

15. The shielded coaxial cable of claim 13 wherein said tubular ferrule is a female ferrule.

16. A connector for electrical connection to a shielded coaxial cable which has an end portion including an exposed length of an inner lead and an exposed length of an inner lead insulator extending from said end portion and a shield layer folded back upon an outer surface of said shielded coaxial cable, said connector comprising:

an elongated metal tubular connector housing extending along a longitudinal axis:

a plastic bushing internal of and attached at one end of said housing, said bushing having a longitudinal bore extending therethrough along said longitudinal axis, said longitudinal bore having a first end for inserting said exposed length of said inner lead and said exposed length of said inner lead insulator when connecting said shielded coaxial cable to said connector; and, a metal tubular ferrule having one end for insertion into an opposite second end of said longitudinal bore when connecting said shielded coaxial cable to said connector, said tubular ferrule including at least one retaining tab which is biased away from said longitudinal axis and against an inner bore wall of said longitudinal bore during said insertion, said at least one retaining tab including an electrical contact tab which is biased toward said longitudinal axis against an outer surface of said inner lead during said insertion.

17. The connector of claim 16 wherein said elongated metal tubular connector housing further includes at least one ribbed portion expanded away from an outer surface of said housing.

18. The connector of claim 16 wherein said at least one retaining tab includes a plurality of retaining tabs.

19. The connector of claim 18 wherein each retaining tab of said plurality of retaining tabs is integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

20. The connector of claim 16 wherein said longitudinal bore includes a first bore length adjacent said first end of said longitudinal bore and a second bore length adjacent said opposite second end of said longitudinal bore, said second bore length having a diameter which is greater than the diameter of said first bore length and extending to said first bore length to form an annular abutment.

21. The connector of claim 20 wherein said at least one retaining tab includes a plurality of retaining tabs each of which is biased away from said longitudinal axis against an inner bore wall of said first bore length during said insertion.

22. The connector of claim 21 wherein each retaining tab of said plurality of retaining tabs is integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

23. The connector of claim 22 wherein said tubular ferrule further includes a ribbed portion for engagement with said annular abutment during said insertion.

24. The connector of claim 16 wherein said housing includes a flanged end portion at said one end and at least one flexible protuberance spaced from said flanged end portion and extending into said housing from an inner surface of said housing, said plastic bushing being held in place between said flanged end portion and said at least one flexible protuberance.

25. The connector of claim 24 wherein said longitudinal bore includes a first bore length adjacent said first end of said longitudinal bore and a second bore length adjacent said opposite second end of said longitudinal bore, said second bore length having a diameter which is greater than the diameter of said first bore length and extending to said first bore length to form an annular abutment.

26. The connector of claim 25 wherein said at least one retaining tab includes a plurality of retaining tabs each of which is biased away from said longitudinal axis against an inner bore wall of said first bore length during said insertion.

27. The connector of claim 26 wherein each retaining tab of said plurality of retaining tabs is integral with said tubular ferrule and protrudes at an angle away from an axis of said tubular ferrule and away from said one end of said tubular ferrule, and further wherein each electrical contact tab is integral with a respective retaining tab and protrudes at an angle toward said axis of said tubular ferrule and away from said one end of said tubular ferrule.

28. The connector of claim 27 wherein said tubular ferrule further includes a ribbed portion for engagement with said annular abutment during said insertion.

29. The connector of claim 28 wherein said tubular ferrule is a male ferrule.

30. The connector of claim 28 wherein said tubular ferrule is a female ferrule.

* * * * *